United States Patent [19]

Berger et al.

[11] Patent Number: 4,603,561

[45] Date of Patent: Aug. 5, 1986

[54] CROCHET TOOLS FOR PRODUCING STRIPS ON A CROCHET GALLOON MACHINE

[76] Inventors: Josef Berger, Hainstrasse 11, Schwaebisch Gmuend-Grossdeinbach; Johann Berger, Obere Schloss-Strasse 114, Alfdorf, both of Fed. Rep. of Germany

[21] Appl. No.: 560,003

[22] Filed: Dec. 9, 1983

[30] Foreign Application Priority Data

Nov. 27, 1982 [DE] Fed. Rep. of Germany ..... 32440146
Nov. 27, 1982 [DE] Fed. Rep. of Germany ..... 82333807[U]
Nov. 19, 1983 [EP] European Pat. Off. ..... 831115860

[51] Int. Cl.[4] ..... C03B 15/02

[52] U.S. Cl. ..... 66/203; 66/114; 66/207; 66/214

[58] Field of Search ..... 66/203, 207, 208, 214, 66/87, 120, 119, 114

[56] References Cited

U.S. PATENT DOCUMENTS

| | | | |
|---|---|---|---|
| 2,113,788 | 4/1938 | Hirsch | 66/114 |
| 2,254,201 | 9/1941 | Anderson | 66/114 |
| 2,273,246 | 2/1942 | Anderson | 66/87 |
| 2,654,237 | 10/1953 | Noe | 66/114 |
| 2,913,888 | 11/1959 | Amidon | 66/214 |
| 3,823,581 | 7/1974 | Russo | 66/208 |
| 4,092,838 | 7/1978 | Gangi | 66/207 |
| 4,176,530 | 12/1979 | Cheynet | 66/203 |
| 4,202,185 | 5/1980 | Lesley | 66/203 |
| 4,266,411 | 5/1981 | Lindner et al. | 66/203 |
| 4,331,009 | 5/1982 | Kohl | 66/214 |

FOREIGN PATENT DOCUMENTS

| | | | |
|---|---|---|---|
| 488040 | 5/1970 | Switzerland | 66/203 |
| 2027757 | 2/1980 | United Kingdom | 66/203 |

OTHER PUBLICATIONS

Reisfeld, "Warp Knit Engineering" Yarn Guides, pp. 161, 162, New York, N.Y.

*Primary Examiner*—Ronald Feldbaum
*Assistant Examiner*—Mary A. Ellis
*Attorney, Agent, or Firm*—Cushman, Darby & Cushman

[57] ABSTRACT

Crochet tools for producing bands on a crochet galloon machine. For the production of thin bands on ten or more crochet needles (10, 10') per centimeter of width, the stems of the crochet needles (10,10') are clamped over more than half the length of the needle. A knocking-over bar (20) fastened to the machine has a free straight edge (66) which adjoins closely but without play those parts of the crochet needles (10,10') which project out of the clamp device. The crochet needles are clamped with adequate security against lateral bending. There is no friction between the crochet needles at the knocking-over bar (20). The crochet needles can be clamped in groups, so that they stiffen one another. For the feeding of elastic threads use is made of combs (6) which are displaced laterally to-and-fro relative to the crochet needles in the working rhythm, but which are disposed at a uniform height relative to the crochet needles.

12 Claims, 10 Drawing Figures

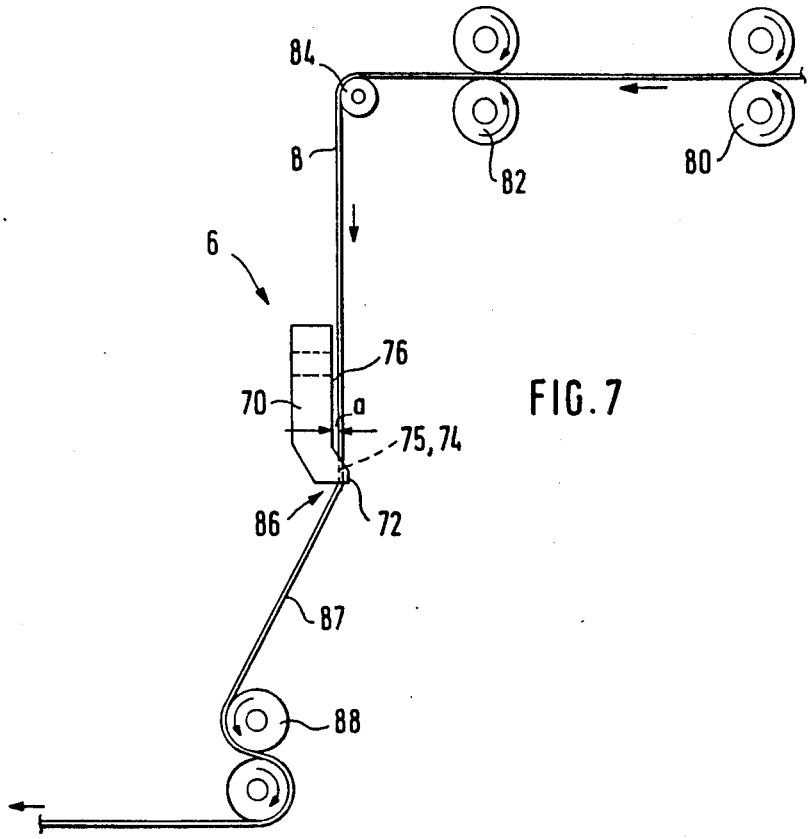
FIG.7
FIG.6
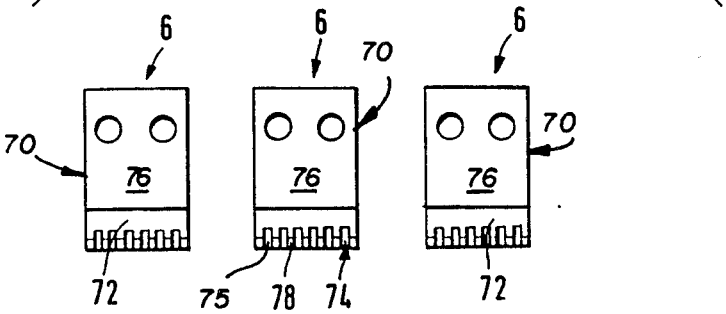

CROCHET TOOLS FOR PRODUCING STRIPS ON A CROCHET GALLOON MACHINE

FIELD OF THE INVENTION

The invention relates to crochet tools for producing bands on a crochet galloon machine.

BACKGROUND AND SUMMARY OF THE PRESENT INVENTION

With known crochet galloon machines it is possible to produce bands on up to six crochet needles per centimeter of working width. At most individual patterns can also be produced on eight crochet needles per centimeter, but larger amounts of band cannot be produced in this way with continuous operation.

Although it is possible to produce bands on eight or more crochet needles per centimeter of working width on Raschel looms, these machines cost six to eight times as much to purchase as a crochet galloon machine. Moreover, they have a minimum working width of 2 to 3 meters. For economical production a relatively large number of bands must be produced side by side in order to utilise the entire working width. This entails a relatively long preparation time. Raschel looms can therefore be used economically only for producing large amounts of bands. For smaller amounts it is economically preferable to use a crochet galloon machine. Such machines moreover have a working width of only 35 to 80 centimeters.

In addition, it is possible to produce bands with eight or more threads per centimeter of width on braiding machines. However, with braiding machines the output of bands per unit of time amounts to only about one sixth of that achieved with crochet galloon machines.

With a single crochet galloon machine it is possible to replace 20 braiding machines, each with two braiding heads, or four automatic weaving machines, each with four weaving sections; this shows the economic importance of the use of crochet galloon machines.

Whereas in the production of elastic bands in crochet galloon machines the elastic threads are hooked around directly during the actual production of the band, a braiding machine must be fed with elastic threads previously covered by hooking around. In addition, a braiding machine requires for its bobbins relatively small spools which necessitate continual respooling.

A weaving process moreover does not make it possible to obtain inexpensive elastic bands, because the weaving machine must also be fed with previously covered elastic threads.

Known crochet galloon machines are however not suitable for the production of relatively large amounts of bands on more than six crochet needles, that is to say with more than six elastic threads per centimeter of width. The arrangement and the guiding of the crochet needles are not suitable for this purpose, nor are known guide needles suitable for feeding elastic threads.

In known crochet galloon machines the ends of the stems of the crochet needles are clamped fast in a clamp device on the needle bar. The free ends of the crochet needles, which project a relatively great distance, are moved to-and-fro in the comb of a knocking-over bar, which is joined to the needle bar.

The needle stems necessarily have clearance between the prongs of the needle comb. Since during the crochet operation the needle heads must intermittently project relatively far out of the needle comb, the crochet needles may in addition become laterally bent. This has the consequence that warp threads are occasionally not laid in the correct needle heads, but in neighbouring needle heads, and also that threads which are to be worked in, particularly elastic threads, are not laid in the correct gap between crochet needles, but are laid at the side of it. In such cases it is no longer possible to form perfect wales.

Because of the continual reciprocating movement inside the needle comb, the crochet needles are subject to wear. In a machine which is operated in two shifts on each working day at a rate of 800 revolutions, that is to say to-and-fro movements of the crochet needles, per minute, the crochet needles have to be replaced roughly every two months. The fact that the crochet needles are roughened by friction of steel on steel also has disagreeable consequences, since this leads to an irregular stitch pattern in the bands produced.

The present invention seeks to construct the crochet tools in a crochet galloon machine in such a manner that bands can be produced on more crochet needles per centimeter of working width than is possible in the prior art, particularly on at least ten crochet needles per centimeter of width. The crochet needles should nevertheless be suitable for working elastic threads. In addition, the crochet needles should be protected against wear.

This problem is solved by the present invention.

In contrast to the prior art, the stems of the crochet needles are no longer guided in a comb of the knocking-over bar.

On the contrary, they move reciprocatingly close above a free edge of the knocking-over bar. The crochet needles are accommodated in a clamp device, which is moved reciprocatingly with the needle bar. The needle stems are clamped down relatively far towards the needle head, so that their working regions remaining free can no longer be bent sideways to a disturbing extent. All play, such as that between the prongs of the previously known needle combs, is eliminated. (The term "working region" of a needle should be understood to mean the region on which the loops of the stitches being formed have to move to-and-fro.)

Owing to the fact that the working regions of the crochet needles no longer move to-and-fro between the prongs of a comb on the knocking-over bar, but move freely above the free edge of the knocking-over bar, there is absolutely no friction on the latter. The crochet needles have a substantially longer life, namely more than a year, as compared with two months in the example given above. Moreover, the advantageous effect is achieved that the crochet needles are not only not roughened, but on the contrary are polished by the threads being worked. It is found that the stitch pattern in the bands produced becomes more regular and cleaner in the course of the first few weeks after the installation of new crochet needles.

FURTHER DEVELOPMENTS OF THE INVENTION

The stems of the crochet needles can be fitted individually with a press fit, that is to say without play, in slots in the clamp device. Alternatively crochet needles can also be inserted into the clamp device and pressed against one another with the interposition of spacers.

It is known in crochet galloon machines for the stems of crochet needles to be clamped in the clamp device by inserting into a channel in the clamp device a clamp slide which has the same needle pitch as the bottom part of the clamp device. It can be made to slide transversely to the stems of the crochet needles and serves for clamping the crochet needles fast relative to the bottom part. Through a further development of the invention it is possible to clamp groups of crochet needles instead of individual crochet needles, for which purpose the recesses in the bottom part and in the clamp slide are made correspondingly wide. It is thus ensured in a particularly reliable manner that all lateral play between the crochet needles is avoided and that the stems of the crochet needles stiffen one another laterally, so that none of the stems can be bent. Bending is still possible only in the working regions. This bending, however, is so slight that it does not hinder the reliable insertion of warp threads and, where applicable, of elastic threads.

Crochet needles suitable for a clamp device of this kind need only straight-ended stems, that is to say need no hook at the end of the stem, so that manufacture of the crochet needles is simplified and made less expensive.

Within each group the crochet needles can be inserted individually. If the clamp slide is moved inside the channel after the insertion of needle groups, and is clamped against the needle stems, the crochet needles are thereby held together in groups.

In the production of elastic bands, the arrangement of ten or more crochet needles per centimeter of working width entails different feeding of the elastic threads from that employed in the prior art. For this purpose it is customary to use individual guide needles, through the eyes of which the elastic threads are guided. With a pitch of ten or more elastic threads per centimeter, a thickness of only about 0.3 millimeter would be available for the individual guide needles, since room must also be left for the elastic threads, which must move in S-form through the eyes of the guide needles.

In accordance with a further development of the invention, each packet of guide needles can be replaced by a comb, in the slits in which the elastic threads are guided. Lateral bending of individual thin guide needles is thereby avoided. In addition, the troublesome threading of the elastic threads into the eyes of the guide needles is avoided. Finally, the guiding of the elastic threads in S-form at the eyes and the consequent friction are avoided. As is well known, this friction leads to roughening of the elastic threads and consequently to a reduction in their breaking strength.

The known guide needles serving to insert the elastic threads are moved up and down together with the inserters for the weft threads (weft-thread guides) in the prior art. This upward and downward movement is however necessary only for the weft-thread inserters themselves, but not for the feed means for the elastic threads. Therefore, the combs can be disposed at a uniform height relative to the knocking-over bar, so that they only make the lateral reciprocating movements. Friction on the elastic threads is thereby reduced.

The following is still more important: since elastic threads are not endless, they must be joined by knotting. The known guide needles move up and down relatively quickly, while the elastic threads are fed substantially more slowly. If the combs were also to move up and down, every knot would have to move up and down from 20 to 30 times inside a comb before it is hooked in, particularly running over the upper and lower edges of the comb. Knots may thus tear open, giving rise to the stoppage of the machine and a loss of production. In addition, the abrupt increase in friction when a knot enters a comb would abruptly increase the tension of the elastic thread, thus leading to an irregular stitch pattern.

A plurality of combs can be disposed serially and be adjustable relative to the crochet needles, so that the slits in the combs can be accurately adjusted relative to the crochet needles clamped in the clamp device.

Examplary embodiments together with other features of the invention are described below with reference to the drawings, in which:

BRIEF DESCRIPTION OF THE DRAWINGS

FIG. 6 is a side view of a plurality of combs disposed side by side.

FIG. 7 shows the combs in front elevation and the guiding of elastic threads and an elastic band.

As shown in FIG. 1, the following known crochet tools are provided: groups of guide needles 2 for feeding warp threads 4, a front tubular weft-thread guide 14 for feeding the front weft thread 17, and also a rear tubular weft-thread guide 15 for feeding the rear weft thread 18.

Figure 1:
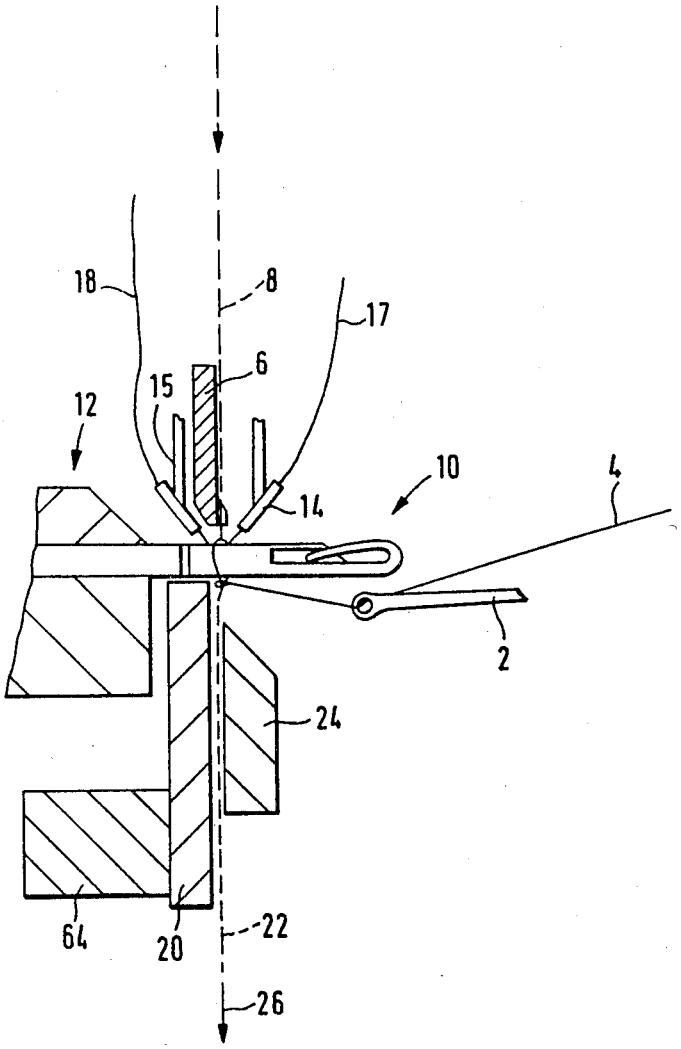
FIG. 1 is a basic illustration of crochet tools arranged in accordance with the invention in a crochet galloon machine, partly in cross-section and partly in side elevation.

DETAILED DESCRIPTION OF THE PREFERRED EXEMPLARY EMBODIMENT OF THE PRESENT INVENTION

According to details of the present invention, groups of crochet needles 10 or individual crochet needles are clamped in a clamp device 12 or 12' in accordance with the invention. If desired, elastic threads 8 are fed through combs 6.

In the production of a plurality of elastic bands, which are produced side by side in a plurality of work stations, groups of elastic threads 8 are fed through the combs 6 to the work station. The front and rear weft-thread guides 14 and 15 respectively are moved from front to rear in the drawing to lay one weft thread transversely over each group of elastic threads 8.

The groups of guide needles 2 each lay one group of warp threads 4 alternately from right and left into the heads of the crochet needles 10. Together with the reciprocating movement of the crochet needles and with the cooperation of a knocking-over bar 20, a group of stitches lying side by side is formed, these stitches enclosing the elastic threads and joining them to the weft threads. The completed elastic bands 22 are drawn off downwards between the knocking-over bar 20 and a retaining bar 24, in the direction of an arrow 26.

Figure 2:
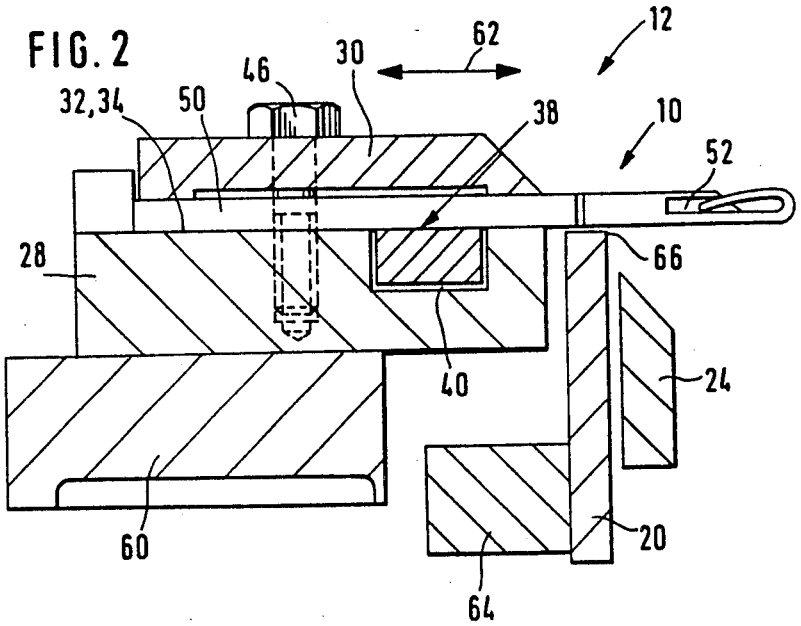
FIG. 2 shows crochet needles in accordance with a first embodiment of the invention, with their holding device and an associated knocking-over device, in cross-section.
Figure 3:
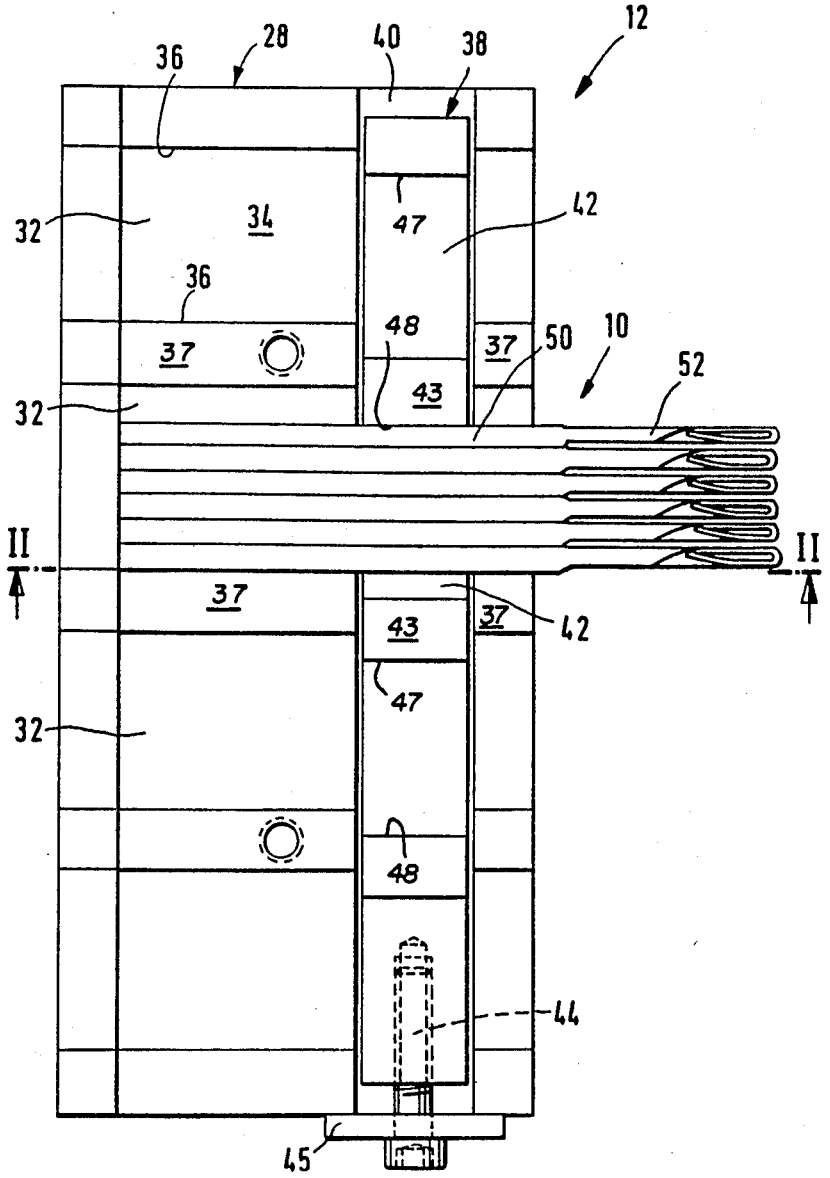
FIG. 3 shows for the same embodiment a clamp device for groups of crochet needles with the clamp cover removed, only one group of crochet needles being shown.

FIGS. 2 and 3 show a form of construction of a clamp device, by means of which the groups of crochet needles can be clamped. The clamp device 12 has a plate-like bottom part 28 and a clamp cover 30. In the plan view in FIG. 3 it is possible to see in the bottom part four needle beds 32, which are parallel to one another and which have a flat bottom 34 and side walls 36 extending at right angles thereto thus defining lands 37. All four needle beds extend parallel to one another. Each of them is of sufficient width to hold a group of crochet needles 10.

Only in one of the needle beds has a group of only six crochet needles 10 been shown. Each needle bed may however also hold more crochet needles.

Figure 10:
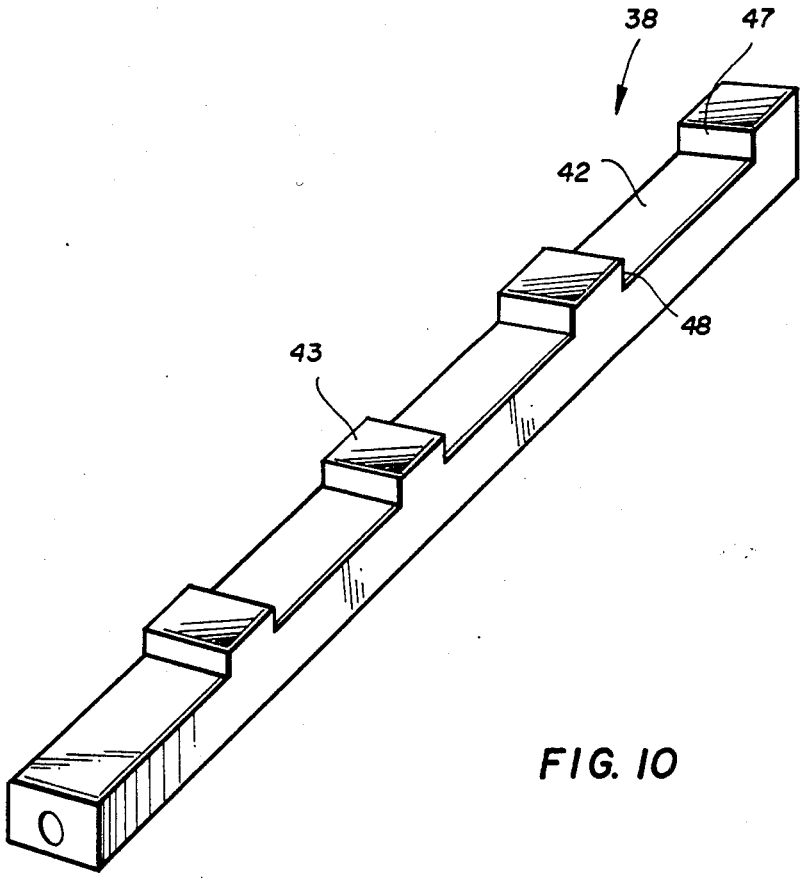
FIG. 10 is a diagrammatic perspective view of a clamp slide shown in FIGS. 2 and 3.

If a plurality of individual crochet needles 10 are to be inserted close side by side into the needle beds, the clamp device is further provided with a clamp slide 38, which is of rectangular cross-section and is disposed for sliding transversely to the crochet needles 10 in a rectangular channel 40 in the bottom part. The clamp slide 38 also has wide needle beds, which are here designated 42 and which likewise have a flat bottom and side walls 47,48 lying at right angles thereto defining land portions 43. This clamp slide 38 is also shown in FIG. 10. The needle beds 32 and 42 in the bottom part and in the clamp slide are milled in one and the same machining operation, so that the two groups of needle beds have equal widths and equal mutual spacing. The clamp slide 38 can be pulled by means of a clamp screw 44 against a plate 45 fastened on the bottom part. The groups of crochet needles 10 are thus pressed by one vertical side wall of land 43 of the clamp slide 38 against the opposing side wall of land 37 of the needle beds 32 as shown in FIG. 3, and thus firmly clamped sideways therebetween. Finally, the clamp cover 30 is screwed tight in relation to the bottom part 28 and the stems 50 of the crochet needles 10 by means of threaded bolts 46. The stems of the crochet needles 10 are thus secured both sideways and from top to bottom. A movement of any kind of the stems relative to one another or the bending of the stems is no longer possible.

Figure 4:
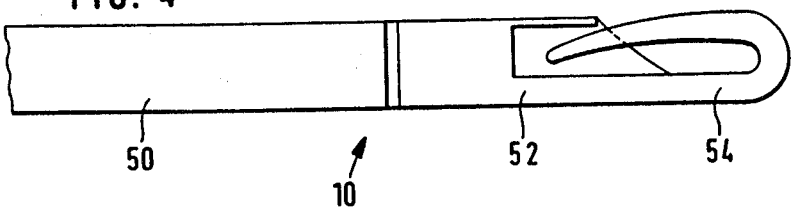
FIGS. 4 and 5 show the front parts of a group of four crochet needles and their working regions, in side and plan view respectively.
Figure 5:
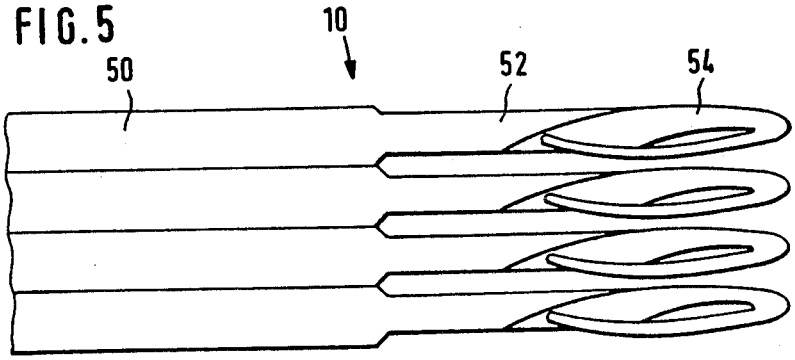

As FIGS. 4 and 5 show, each of the crochet needles 10 has a stem 50, of which only the right-hand part is shown, and a working region 52 which receives the loops of the stitches which are to be formed. This working region may have a smaller width than the stem 50.

Instead of crochet needles of this type, it is also possible to use crochet needles whose working regions have the same width as the stems. In this case spacers must be inserted between the stems on the left (in FIG. 2) of the working regions.

If it is not desired to insert individual crochet needles in the needle beds (32) of the clamp device, crochet needles may be formed into groups, which can be done by soldering or casting in a composition which subsequently sets. The composition may be a lead alloy or a plastics material. If use is made of packets of needles prepared in this way, that is to say groups of crochet needles previously joined together firmly, the clamp device (12) may be made simpler than the description given. The clamp slide 38, the channel 40 and the clamp screw 44 are no longer required.

As FIG. 2 shows, the clamp device is fastened on the needle bar 60 of the crochet galloon machine and is moved to-and-fro together with the latter in the direction of the double arrow 62 parallel to the needles. The knocking-over bar 20 is fastened on the main cross member 64 fixed to the crochet galloon machine. It extends upwards to a point close below the crochet needles 10 and ends there with a straight edge 66.

FIGS. 6 and 7 show in detail the arrangement for feeding the elastic threads. Each comb 6 has a plate-like part 70 which at its bottom edge (referring to the Figures) has a bead-like thickening 72 of roughly triangular cross-section. Slits 74 are cut in this thickening, with their bottom or interior surface which is spaced from surface 76 by 75 a distance a and they extend parallel to surface 76 of plate-like part 70. The pitch of the slits is the same as that of the clamped crochet needles. For a pitch of 10, ten slits are cut per centimeter. Both the slits and the lands 78 lying between them then have a width of about 0.5 millimeter.

A plurality of combs 60 are disposed side by side. Each of them has a number of slits equal to the number of elastic threads 8 to be contained in a band. The combs are adjustable relative to one another and are aligned to the clamped crochet needles.

The elastic threads 8 are fed by feed rollers 80 and 82, whose speeds of rotation are approximately in the ratio of 1:3, so that the elastic threads are tensioned. The threads then pass around a guide roller 84 and run through the slits 74. At the work station 86 elastic bands 87 are formed, which are then pulled off by pull-off rollers 88. The speeds of rotation of the feed rollers 82 and the pull-off rollers 88 are approximately in the ratio 3:4. The elastic threads 8 and the elastic bands 87 thus receive additional tensioning, whereby the elastic threads are held on the bottom surface 75 of the slits 74.

The combs 6 are mounted on a guide bar in the crochet galloon machine so as to be laterally adjustable, and together with the guide bar are moved to-and-fro laterally by one needle division at a time. The elastic threads are only slightly diverted, and the combs do not move in the longitudinal direction of the elastic threads, so that the friction is greatly reduced. Knots in the elastic threads fed need to pass only once from top to bottom through each comb. The thread guides 14 and 15 (FIG. 1) are moved in known manner in the longitudinal direction of the combs and also upwards and downwards.

Figure 8:
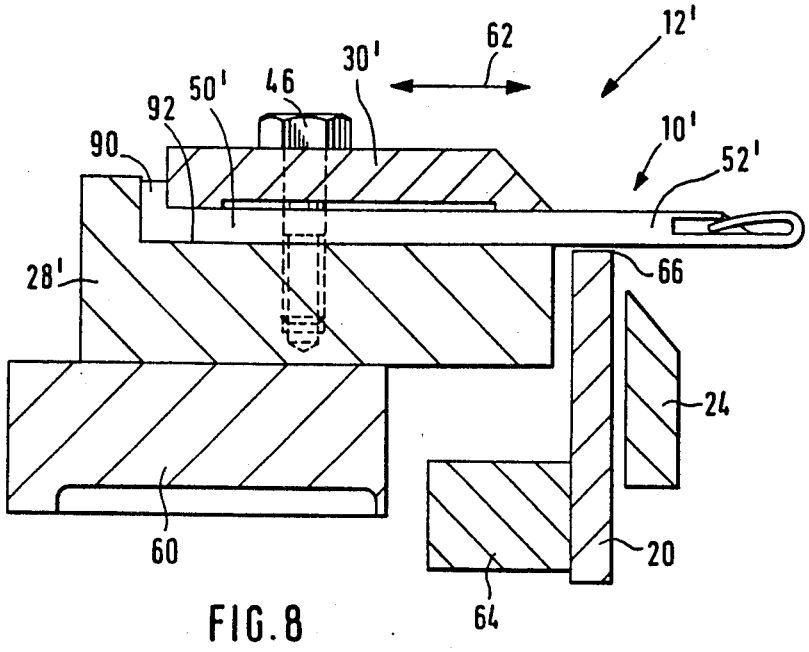
FIG. 8 shows in cross-section, similarly to FIG. 2, another embodiment of the invention, with a different clamp device.
Figure 9:
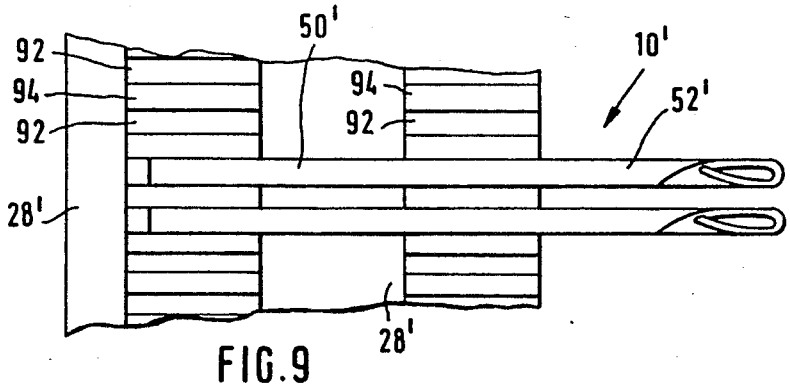
FIG. 9 is a plan view of a portion of the bottom part of the clamp device shown in FIG. 8.

FIGS. 8 and 9 show a different form of construction of the clamp device and crochet needles. The crochet needles 10' have a bent-over rear end 90. The clamp cover 30' is accordingly narrower than the embodiment shown in FIG. 2. The rear end of the clamp cover 30' holds the needle end 90 fast. As is known per se, the clamp cover presses against the needle stems only by its front and rear edges (on the right and left respectively in FIG. 8). The same applies to the clamp cover 30 in FIG. 2.

As FIG. 9 shows, the bottom part 28' has a needle bed with narrow slots 92, the width of which is such that the crochet needles can be inserted into the slots only by the application of some force, that is to say with a press fit. Each two slots 92 are separated from one another by a land 94 of the same width. With ten needles per centimeter of width, the needle stems 50', the slots 92 and the lands 94 have respective widths of about 0.5 mm. The exact dimensions result from the requirement that a press fit must be achieved. The working regions 52' of the crochet needles here have the same width as the stems 50'.

It is important for all the examplary embodiments of the invention that the stems 50' of the crochet needles should be clamped over a length which is greater than half the length of the needles. If a crochet needle has a length of 77 millimeters, a length of 47 to 49 millimeters thereof is clamped.

The slots 92 shown in FIG. 9 extend with the same pitch over the entire length of the bottom part 28' of the clamp device, with the exception of those parts which must remain free for the insertion of the threaded bolts 46 (FIG. 2). Depending on the width of the bands desired and the number of elastic threads in them, more or fewer crochet needles are formed into a group in each case. One of the combs 6 shown in FIG. 6 and one group of guide needles 2 (FIG. 1) are then allocated to each of these groups. Both the combs and the groups of guide needles are adjusted laterally in relation to the clamped crochet needles, that is to say in the longitudinal direction of the clamp device 28 or 28'.

We claim:

1. Crochet tools for producing bands on a crochet galloon machine, characterised by the following features:

a needle bar of said crochet galloon machine having a plurality of needles and a clamp device in which needle stems of said needles are clamped over more than half the length thereof, and;

a knocking-over bar fastened to said machine having a free straight edge which adjoins closely those parts of said needles projecting outwardly beyond said clamp device.

2. Crochet tools according to claim 1, characterised in that the clamp device is provided with means defining slots each for receiving a crochet needle and the stems of said crochet needles are individually press fit in said slots in the clamp device.

3. Crochet tools according to claim 1, characterised in that the stems of the crochet needles are inserted into the clamp device without play, with the interposition of spacers.

4. Crochet tools according to claim 1, wherein the clamp device has a plate-like bottom part with means defining at least one needle bed and one clamp cover adapted to be securely clamped against the crochet needles and said bottom part, said bottom part having means defining a channel extending at right angles to said at least one needle bed; a clamp side having a cross-section dimensioned to fit into said channel means, and means defining at least one needle bed therein disposed with the same spacing as said at least one needle bed provided in said bottom part; and means for moving the clamp slide in a longitudinal direction along said channel means and thus to so that said crochet needles are clamped between said at least one needle bed in said bottom part and said at least one needle bed in said clamp slide.

5. Crochet tools for producing bands in a crochet galloon machine as in claim 1, further including at least on comb-like member having means defining a plurality of slits extending parallel to one another, said slits having a pitch which is the same as the pitch of the clamped crochet needles and means for operating said comb so that said comb is laterally displaced by one needle division at a time, alternately to the left and to the right, in a timed manner to the operation of said crochet galloon machine.

6. Crochet tools according to claim 5, characterised in that the comb is disposed at a uniform height relative to the knocking-over bar.

7. Crochet tools according to claim 5, including a plurality of combs disposed serially across said crochet galloon machine, said combs being adjustable in a cross-machine direction relative to the clamped crochet needles.

8. Crochet tools according to claim 5, characterised in that the comb is in the form of a substantially plate-like part having a predetermined width which on one longitudinal edge has a bead-like thickening portion, said slits being provided in said thickening portion so that said slits are spaced apart across the width thereof.

9. Crochet tools according to claim 8, characterised in that the bead-like thickening portion has a substantially triangular cross-section, such that the thickening increases in the direction of the longitudinal edge of the plate-like part.

10. Crochet tools according to claim 8, wherein said slits have a bottom surface and said plate-like part has a surface facing in the same direction as said slits, whereby the bottom of said slits is spaced a distance (a) from said surface of the plate-like part.

11. Crochet tools as in claim 4 including at least one group of a plurality of crochet needles and wherein the at least one needle bed in both said bottom part and said clamp slide are formed as a shallow recess having a flat bottom.

12. Crochet tools as in claim 11, wherein the width of said shallow recess is wider than at least the width of three of said needle stems.

* * * * *